United States Patent [19]

Wuthrich et al.

[11] Patent Number: 4,800,545

[45] Date of Patent: Jan. 24, 1989

[54] REMOVABLE STEM AND SWITCH ACTUATOR FOR ELECTRONIC WRISTWATCH

[75] Inventors: Paul Wuthrich, Watertown; Edward Kaulins, New Milford, both of Conn.

[73] Assignee: Timex Corporation, Waterbury, Conn.

[21] Appl. No.: 33,933

[22] Filed: Apr. 3, 1987

[51] Int. Cl.[4] ..... G04B 27/02; G04B 29/00

[52] U.S. Cl. ..... 368/190; 368/321

[58] Field of Search ..... 368/219, 320, 321, 190–199

[56] References Cited

U.S. PATENT DOCUMENTS

| | | | |
|---|---|---|---|
| 3,377,796 | 4/1968 | Rogers | 368/319 |
| 3,623,315 | 11/1971 | Christe | 368/190 |
| 3,707,840 | 1/1973 | Miyasaka | 368/320 |
| 3,975,896 | 8/1976 | Kasama | 368/319 |
| 4,034,553 | 7/1977 | Wuthlich | 368/320 |
| 4,104,866 | 8/1978 | Chappatte | 368/319 |
| 4,363,554 | 12/1982 | Schaffner et al. | 368/190 |
| 4,408,896 | 10/1983 | Ikegami | 368/319 |

*Primary Examiner*—Bernard Roskoski

*Attorney, Agent, or Firm*—William C. Crutcher

[57] ABSTRACT

An electronic wristwatch includes an electronic circuit such as a lead frame with extending conductive strips providing a first battery contact terminal and switch contact terminal for operating and setting the wristwatch. A multipurpose switch actuator makes continuous electrical contact between the wristwatch battery and the first contact terminal, and makes selective switching contact with the second contact terminal when actuated by a push-pull detented stem. The stem is removable when twisted using a tool so as to unseat the detent spring, so that it can be pulled from the watch frame, and is also reinsertable without disassembling the watch. The switch actuator serves various other functions, including spring biasing of the stem detent and holding the electronic circuit lead frame in the watch frame.

11 Claims, 3 Drawing Sheets

REMOVABLE STEM AND SWITCH ACTUATOR FOR ELECTRONIC WRISTWATCH

BACKGROUND OF THE INVENTION

This invention relates generally to an electronic wristwatch with a manually operated stem operating a switch actuator inside the watch to control its operation, and more particularly to a wristwatch in which the stem may be removed from the wristwatch and reinserted without disassembling the watch. Such watches include an internal electronic circuit and a battery supplying power to the circuit. The circuit generally includes a quartz crystal timebase, an integrated circuit with a frequency divider chain for supplying low frequency timekeeping pulses, and means to display the time either by actuating segments on an electrooptic display, or by operating a motor and gear train to drive the hands of the wristwatch. Although the invention will be described in connection with the latter type of timekeeping display in the context of a quartz analog wristwatch, the invention is equally applicable to a timepiece with an electrooptic display.

Manually operated crowns with stem detenting springs for holding the stem in selected axial positions and permitting axial movement of the stem against spring pressure provided by a detenting spring are well-known in the art. Examples are illustrated in U.S. Pat. Nos. 3,678,682 and 3,707,840, both issued to Miyasaka; U.S. Pat. No. 4,034,553 —Wuthrich, 4,228,647 —Yajama, and 4,363,554 —Schaffner et al., these being merely exemplary. In such stem detenting devices, the grooves in the stem between detenting surfaces are circumferential and hence there is no way to remove the stem without disassembling the watch, so that the detent spring can be detached.

The prior art also includes push button switch actuators for electronic wristwatches, which have only one normal axial position and are pushed against a spring bias, examples being shown in U.S. Pat. No. 3,783,607 —Feurer, U.S. Pat. No. 4,031,341 —Wuthrich et al., and U.S. Pat. No. 4,400,095 —Namyslo.

It is also well-known in the art to manipulate an external crown to operate internal stem-detented switch actuators for electronic wristwatches, as are illustrated in U.S. Pat. Nos. 3,526,088 —Meitinger, 4,031,341 —Wuthrich et al., and 4,536,095 —Wuthrich et al., all assigned to the present assignee. The last named Wuthrich patent 4,536,095 employs a rocking contact switch with a detented stem comprising semicircular detent grooves on one side of the stem and a flat surface on the other side of the stem. The stem is removable by inserting a tool and relieving the spring pressure by actuating extension arm on the detent rocker contact spring.

In order to reduce the manufacturing cost of an electronic wristwatch, it is desirable to have as few parts to be assembled as possible and for each of the parts to perform several functions. The parts are preferably designed to facilitate assembly and disassembly.

Accordingly, one object of the present invention is to provide an improved electronic wristwatch with a detented stem and switch actuator.

Another object of the invention is to provide an improved detented stem which may be manually actuated without danger of it coming out of the watch, but which may be removed and reinserted at repair facilities without disassembling the wristwatch.

Still another object of the invention is to provide an improved internal switch actuator for selectively operating the circuit of an electronic wristwatch.

Another object of the invention is to provide an simplified removable stem and switch actuator for an electronic wristwatch having a minimum number of parts.

SUMMARY OF THE INVENTION

Briefly stated, the invention is practiced by providing a removable stem and switch actuator assembly for an electronic wristwatch of the type having a frame, an electronic circuit including at least first and second contact terminals, and an energy cell disposed in the frame. In its simplest form, a cylindrical stem which is slidably and rotatably disposed in the watch defines a first deep lateral detent groove and a second shallow lateral detent groove with inclined detenting surfaces therebetween. A conductive switch actuator mounted in the watch frame includes a detent portion adapted to fit in said grooves, at least one electrically conductive spring portion biasing the detent portion into the grooves, and a switch contact portion selectively making electrical contact when the stem is actuated by an external crown to place the detent portion in the deep lateral groove. In the preferred embodiment, the switch actuator has a member which makes continuous electrical contact between the battery and the first battery contact terminal on the electronic circuit, and makes selective contact with the second switching contact terminal on the electronic circuit.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawings, in which:

FIG. 1 is a plan view of a quartz analog wristwatch movement illustrating the preferred embodiment of the invention, FIG. 2. is a plan view of the electronic circuit including lead frame and quartz crystal, FIG. 3 is a side elevation view of the stem and crown assembly, FIG. 3*a* is a cross-section taken through lines A—A of FIG. 3, FIG. 3*b* is a cross-section taken through lines B—B of FIG. 3, FIG. 4 is a plan view of the switch actuator, FIG. 5 is an end elevation of the switch actuator together with portions of the stem, battery, and contact terminals, FIG. 6 is a projected end view of the detent and switch contact portion of the switch actuator, together with portions of the stem and contact terminal FIG. 7*a* is an elevation drawing of the stem and portions of the switch actuator with the stem in the "in" position, FIG. 7*b* is the same as FIG. 7*a*, but illustrating the stem in an "out" position, FIG. 7*c* is the same as FIG. 7*a*, but with the stem rotated 180 degrees for removal, and FIG. 7*d* is the same as FIG. 7*a*, but with the stem removed and shown in the position for insertion.

DESCRIPTION OF THE PREFERRED EMBODIMENT

Figure 1:
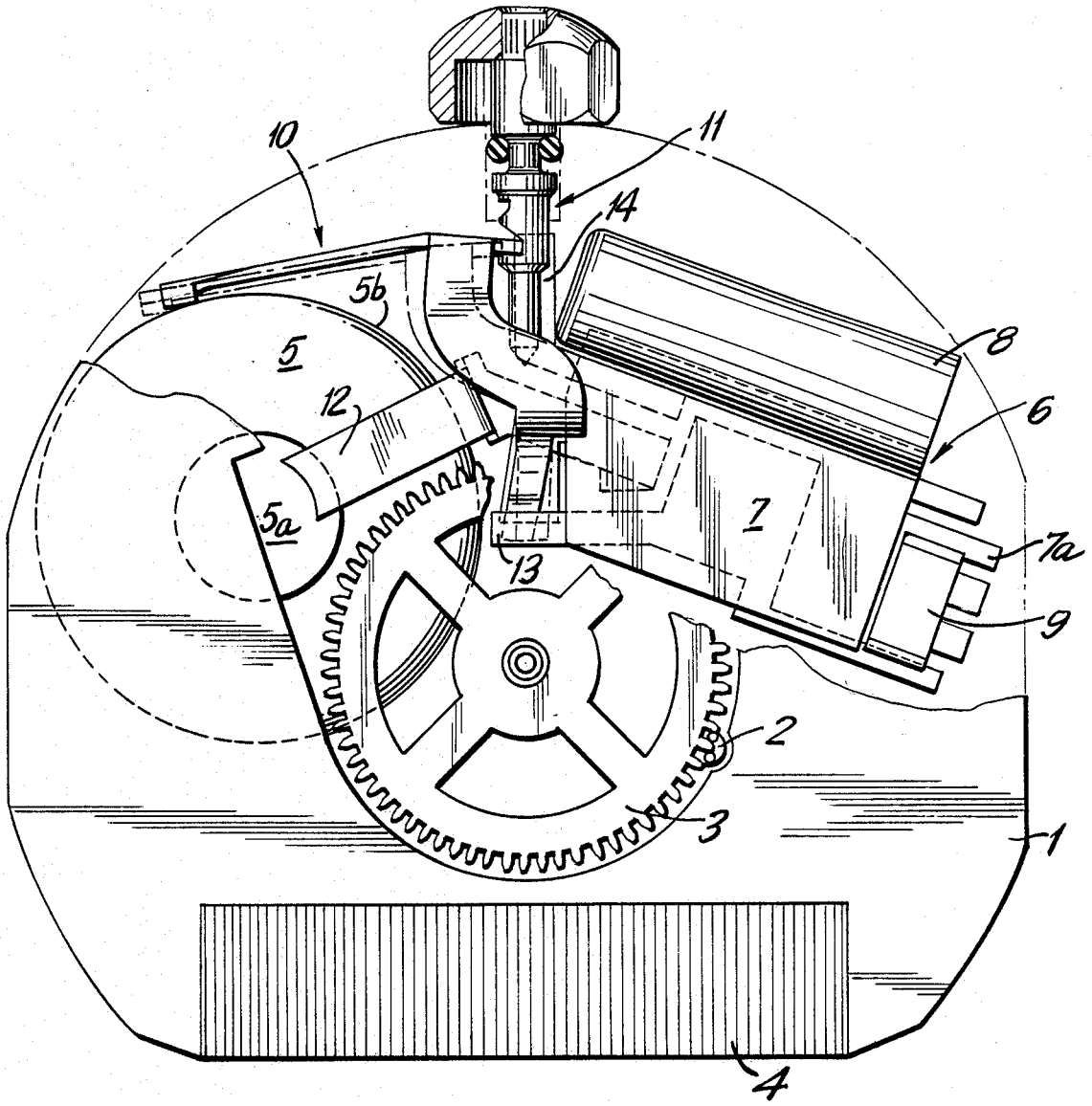

Referring now to FIG. 1 of the drawing, a quartz analog wristwatch movement includes a plastic frame 1. Other parts of the movement include a stepping motor having a rotor 2 driving a center wheel 3 when actuated by pulses supplied to motor coil 4. Other elements (not shown) include a gear train and time indicating hands.

The frame includes a circular recess adapted to receive a button-type battery or energy cell 5 with a negative center terminal 5*a* and with its peripheral edge 5*b* serving as the positive terminal. An electronic circuit, shown generally as 6 comprises an encapsulated lead frame assembly 7 with electrically conductive extending metal strips such as 7*a*. Discrete electrical components include a quartz crystal 8 and capacitor 9. The electronic circuit 6 is a separate unit which can be inserted into a recess in watch frame 1 and is adapted to be held in place on one end by the switch actuator in a manner later to be described.

The foregoing elements comprise conventional elements in a quartz analog electronic wristwatch. The present invention concerns an improved switch actuator shown generally at 10 and a removable stem shown generally at 11 which cooperates with switch actuator 10.

Figure 2:
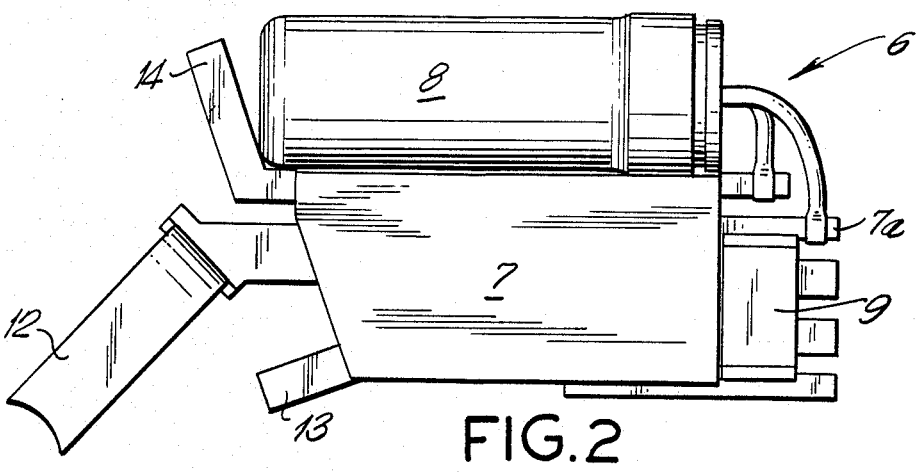

Referring now to FIG. 2, the electronic circuit 6 is a separate subassembly comprising lead frame 7, quartz crystal 8 and capacitor 9. The lead frame 7 is an encapsulant embedding an integrated circuit and having conductive metal spring strips such as 7*a* protruding from the encapsulant and connected internally to the circuit elements. Conductive strips 7*a* serve in some cases as terminals for attaching the discrete elements, such as crystal 8 and capacitor 9, directly to the strips. The strips are also shaped to serve as battery contact terminals and switching contact terminals in a manner which is relevant to the present invention.

More particularly, lead frame 7 includes a negative polarity battery contact terminal 12, a positive polarity battery contact terminal 13, and a switching contact terminal 14. The circuit is arranged in accordance with polarity conventions often employed in wristwatches so that the positive connection is common or grounded to the wristwatch case, while the negative connection is the $V_{ss}$ connection. Accordingly, contact terminal 12 is shaped to contact directly on the battery positive terminal 5*a*. Power is supplied to the circuit when the negative battery connection is made to contact terminal 13. The circuit is also arranged so that when switching contact terminal 14 is connected to ground (positive battery connection), the watch changes from a normal timekeeping to a setting mode, in which the stepping motor is actuated at a high speed to rotate the hands for setting the watch. The particular type of setting or switching accomplished by the switching contact terminal 14 is not important to the present invention.

Figure 3:
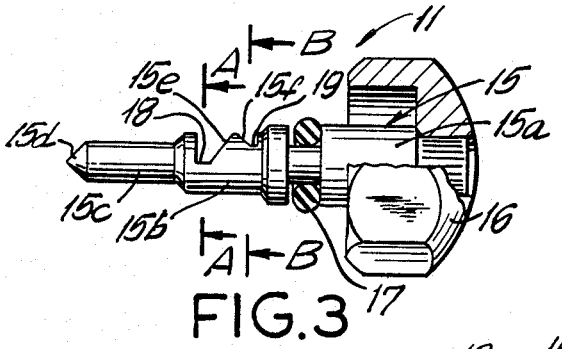
Figure 3A:
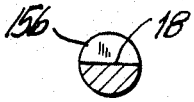
Figure 3B:
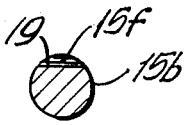

Reference to FIG. 3 and the cross-section FIGS. 3*a* and 3*b* illustrate the removable stem assembly shown generally as 11. The assembly comprises a generally cylindrical stem element 15, a crown 16 press-fit over the end of stem 15, and an O-ring sealing gasket 17 disposed in a circumferential groove in the cylindrical stem element 15. The stem 15 includes a large diameter section 15*a*, an intermediate diameter section 15*b* and a small diameter section 15*c* with a pointed end 15*d*. Of particular importance to the present invention, the intermediate cylindrical portion 15*b* includes a first deep lateral groove 18 and second shallow lateral groove 19, separated by inclined detenting surfaces 15*e*, 15*f*.

Reference to FIGS. 3*a* and 3*b* illustrate that the term "lateral groove" is used as a particular definition in this application to distinguish it from the usual circumferential groove commonly found in watch detenting stems. Although the bottoms of the grooves 18 and 19 are preferably flat (as formed by a chord), they may also be arcuate (concave or convex) to fit the particular type of detenting element used with them.

The crown 16 is selected to be of a small diameter, since the normal operation of the stem by the wearer of the wristwatch is in an axial direction —"in" or "out." The crown is only intended to be rotated for removal of the stem using a tool by an experienced repairman.

Figure 4:
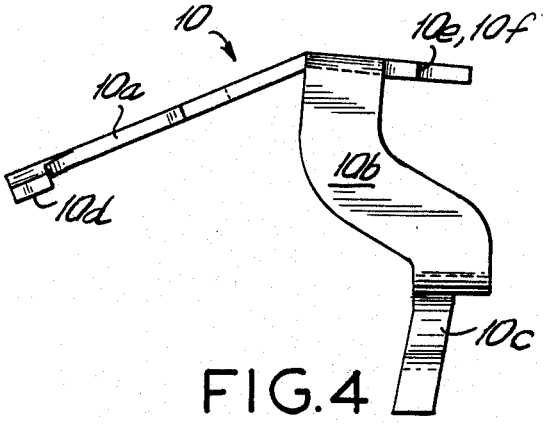
Figure 5:
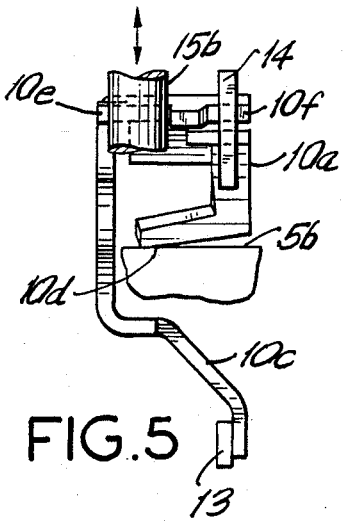
Figure 6:
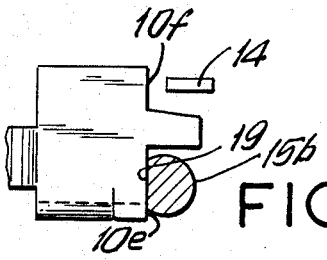

FIG. 4 shows the plan view of the switch actuator 10, while FIGS. 5 and 6 indicate side and end projections respectively of switch actuator 10, showing its cooperation with other elements of the watch.

Referring to FIG. 4, actuator 10 comprises a battery contact and spring biasing arm 10*a*, a central sinuous body 10*b* bent generally at right angles to member 10*a*, and a lead frame contact extension arm 10*c*. The arm 10*a* terminates in a sliding battery contact edge 10*d* (see also FIG. 5) on one end and a detent portion 10*e* and switch contact portion 10*f* (see also FIG. 6) on the other end.

FIGS. 5 and 6 illustrate the cooperation of switch actuator 10 with other elements. In FIG. 5, extension 10*c* is seen making continuous spring biased contact against lead frame battery contact terminal 13. This also serves to hold the electronic circuit assembly 6 in the watch frame (FIG. 1).

The termination 10*d* of arm 10*a* makes electrical contact with the edge 5*b* of the watch battery. This provides a fulcrum for spring biasing the arm, as well as electrical contact with the battery.

As shown in FIG. 6, the cylindrical stem element 15*b* is disposed adjacent the detent edge 10*e*. The springiness of arm 10*a* and its contact with the battery causes the detent portion 10*e* to be biased against the stem and into the lateral grooves 18 and 19 in the stem depending upon its axial position.

As indicated in FIG. 6, the edge 10*f* of actuator spring is spaced from lead frame arm 14 when the detent 10*e* is in the shallow groove 19. When the detent is in the deep lateral groove, edge 10*f* makes electrical contact with switching contact terminal 14, thereby constituting electrical switching means operated by actuator 10 when the stem is axially moved.

OPERATION OF THE INVENTION

Referring to FIGS. 7*a* through 7*d*, the operation of the invention will be illustrated.

Figure 7A:
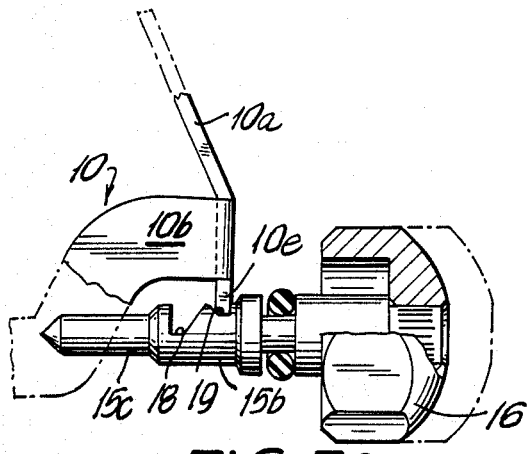

FIG. 7*a* shows the electronic wristwatch in its normal operating position with spring detent portion 10*e* resting in the shallow groove 19 and the stem in its axially inmost position. The switching contacts are open and the positive battery terminal 5*b* is connected to the lead frame contact terminal 13 via the conductive actuator element 10.

Figure 7B:
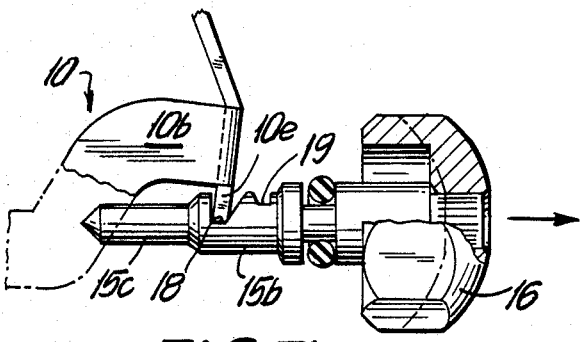

FIG. 7*b* shows the stem pulled to its out position, whereupon the spring detent 10*e* moves into the deep lateral groove 18, allowing contact between switch actuator edge 10*f* and lead frame contact terminal 14

(see FIG. 6). This is the time setting mode of operation by a person wearing the wristwatch. Rotation of the stem is intentionally prevented by using a small diameter crown. A tool is required to supply sufficient torque for removal of the stem.

Figure 7C:
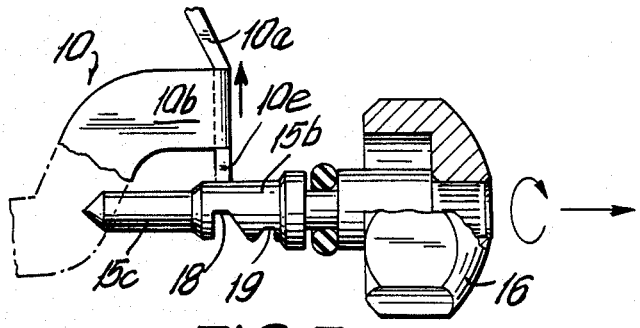

Reference to FIG. 7*c* shows how the stem is removed. A tool is applied to partially rotate crown 16 (180 degrees), thereby raising detent portion 10*e* onto a smooth surface of the stem unseating it from the lateral groove. This permits unobstructed removal of the stem without disassembling the watch.

Figure 7D:
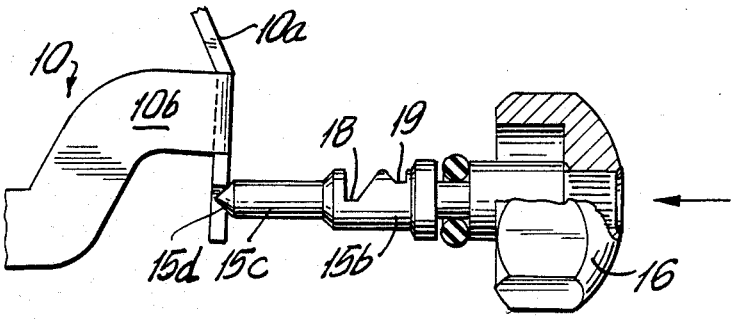

Reference to FIG. 7*d* shows that the stem may then be reinserted and guided by the pointed end 15*d* and other inclined surfaces back into the normal operational position of the shallow lateral groove 19.

The spring force of arm 10*a* is selected to be weak enough to permit manual axial movement of the stem but strong enough, when taking the diameter of the crown into consideration, to prevent manual rotation and unseating of the detent portion of the actuator from the grooves without the assistance of a tool. In other words, by suitable selection of length and stiffness of spring arm 10*a*, together with diameter of crown 16, one can make manual twisting of the crown preventable, e.g. a stiffer, shorter spring arm and a smaller diameter crown requiring more torque than the normal person can supply with his/her fingers. Yet a tool such as a pair of pliers can supply sufficient torque to twist the stem so that it can be removed.

While there has been described what is to be considered to be the preferred embodiment of the invention, other modifications will occur to those skilled in the art, and it is desired to secure in the appended claims all such modifications as fall within the true spirit and scope of the invention.

We claim:

1. A removable stem and switch actuator assembly for an electronic wristwatch having a frame, and an electronic circuit including at least one switch contact terminal, a cylindrical stem disposed in said frame and defining a first deep lateral groove and a second shallow lateral groove, said grooves being axially spaced on the same side of said stem and defining inclined detenting surfaces therebetween, a switch actuator mounted in said frame having a detent portion, a flexible spring portion biasing the detent portion into said stem grooves, and having a switch contact portion adapted to touch said switch contact terminal when the detent portion is biased into said deep groove by axial movement of said stem, whereby partial rotation of the stem raises the detent portion out of said grooves permitting axial removal of the stem from the frame.

2. The combination according to claim 1, wherein said stem includes a small diameter crown disposed outside said frame, said flexible spring portion and diameter of said crown being selected such that axial movement of the stem may be accomplished manually but preventing manual rotation of the stem without the assistance of a tool.

3. The combination according to claim 1 and further including an energy cell disposed in said frame, and wherein said electronic circuit further includes a battery contact terminal, said switch actuator being electrically conductive and having a first extension making contact with said energy cell, and a second extension making continuous electrical contact with said battery contact terminal of the electronic circuit.

4. A combination according to claim 3, wherein said second extension of the switch actuator is shaped to exert a spring bias on said electronic circuit to hold it in said watch frame.

5. A removable stem and switch actuator assembly for an electronic watch having a switching contact terminal controlling a phase of its operation,:

a cylindrical stem slidably and rotatably disposed in said watch, said stem defining a deep lateral detent groove and a shallow lateral detent groove axially spaced from said first groove on the same side of the stem, and defining inclined detenting surfaces therebetween, a switch actuator mounted in said watch having a conductive portion and having a detent portion spring biased toward said stem, electrical switching means operated by said switch actuator when it is detented between deep and shallow grooves by axial movement of said stem, whereby partial rotation of said stem raises said detent portion out of either of said lateral grooves, unseating the detent portion and permitting axial withdrawal of said stem from said watch.

6. The combination according to claim 5, wherein said switching means comprises said conductive portion of said switch actuator disposed adjacent said switching contact terminal.

7. The combination according to claim 5, wherein said switch actuator includes a conductive portion holding said electronic circuit in said watch, and also making electrical contact with said electronic circuit.

8. A removable stem and switch actuator assembly for an electronic wristwatch having a frame, an electronic circuit including a battery contact terminal and a switching contact terminal extending therefrom, and a battery disposed in said frame,:

a cylindrical stem slidably and rotatably disposed in said frame and defining a deep lateral groove and a shallow lateral groove, said grooves being axially spaced on the same side of said stem and having inclined detenting surfaces therebetween, a switch actuator comprising a conductive spring member mounted in said frame and having a flexible spring portion with a first end contacting said battery and a second end defining a detent portion adjacent said spring, said spring portion biasing the detent portion into said grooves, said switch actuator further defining a switching contact terminal disposed adjacent and adapted to touch said electronic circuit switching contact terminal when the detent portion is in the deep lateral groove, whereby axial movement of said stem causes electrical connection between the battery and said switching contact terminal of the electronic circuit.

9. The combination according to claim 8, wherein said switch actuator includes a conductive spring extension making continuous contact with said battery contact terminal of the electronic circuit.

10. The combination according to claim 9, wherein said conductive spring extension is arranged to hold the electronic circuit in the frame.

11. The combination according to claim 8, wherein said stem further includes a small diameter crown and wherein said flexible spring portion is selected to normally permit axial movement of the crown, but to prevent manual rotation of the crown, said crown diameter and said spring portion being adapted to permit the stem to be rotated by a tool to unseat said detent portion and permit withdrawal of the stem from the frame.

* * * * *